US008641552B2

(12) United States Patent
Lu

(10) Patent No.: US 8,641,552 B2
(45) Date of Patent: Feb. 4, 2014

(54) GRIP FOR SPORTING EQUIPMENT

(76) Inventor: Clive S. Lu, Hicksville, NY (US)

( * ) Notice: Subject to any disclaimer, the term of this patent is extended or adjusted under 35 U.S.C. 154(b) by 125 days.

(21) Appl. No.: 13/012,396

(22) Filed: Jan. 24, 2011

(65) Prior Publication Data

US 2011/0118043 A1 May 19, 2011

Related U.S. Application Data

(63) Continuation-in-part of application No. 12/410,973, filed on Mar. 25, 2009, now abandoned.

(51) Int. Cl.
*A63B 53/14* (2006.01)

(52) U.S. Cl.
USPC ..... 473/300

(58) Field of Classification Search
USPC ..... 473/300–303, 549–552, 568
See application file for complete search history.

(56) References Cited

U.S. PATENT DOCUMENTS

| | | | | |
|---|---|---|---|---|
| 979,266 | A * | 12/1910 | Dean | 473/568 |
| 3,311,375 | A * | 3/1967 | Onions | 473/301 |
| 4,133,529 | A | 1/1979 | Gambino | |
| 5,398,930 | A | 3/1995 | Gibson | |
| 5,460,372 | A | 10/1995 | Cook | |
| 5,634,859 | A | 6/1997 | Nesbitt | |
| 5,671,923 | A | 9/1997 | Huang | |
| 5,813,921 | A | 9/1998 | Huang | |
| 5,827,129 | A | 10/1998 | Huang | |
| 5,890,972 | A | 4/1999 | Huang | |
| 5,897,440 | A | 4/1999 | Bae et al. | |
| 6,036,607 | A * | 3/2000 | Finegan | 473/206 |
| 6,286,198 | B1 * | 9/2001 | Riesmeier | 29/525.01 |
| 6,641,488 | B2 * | 11/2003 | Huang | 473/302 |
| 6,656,057 | B2 | 12/2003 | Manual et al. | |
| 6,709,346 | B1 | 3/2004 | Wang | |
| 6,718,675 | B1 * | 4/2004 | Lu | 40/661.12 |
| 6,843,732 | B1 | 1/2005 | Huang | |
| 6,857,971 | B2 | 2/2005 | Huang | |
| 6,908,400 | B2 | 6/2005 | Chu et al. | |
| 7,025,690 | B2 | 4/2006 | Nam | |
| 7,189,168 | B2 | 3/2007 | Lin | |
| 7,214,141 | B2 | 5/2007 | Hung | |
| 7,232,378 | B2 | 6/2007 | Jaw | |
| 7,344,447 | B2 | 3/2008 | Chang | |
| 7,377,859 | B2 | 5/2008 | Reardon | |
| 7,448,957 | B2 * | 11/2008 | Huang | 473/300 |

(Continued)

OTHER PUBLICATIONS

PCT/US09/64968 International Search Report (Jan. 12, 2010).

(Continued)

*Primary Examiner* — Stephen L. Blau
(74) *Attorney, Agent, or Firm* — King & Schickli, PLLC

(57) ABSTRACT

A grip for sporting equipment includes a base defining a receiver for receiving a gripping end. The base includes a pair of opposed grip base ends and an intervening center portion. At least one sheet of material is provided for encircling at least the base center portion. The at least one sheet of material includes at least two opposed beveled edges which when abutting define a seam disposed within a groove. The opposed abutting beveled edges are secured one to the other by stitching disposed within the groove. An adhesive strip overlays the groove and stitching. A substantially transparent top protective layer may overlay at least a portion of the at least one sheet of material, the adhesive strip, and the base. In turn, items of sporting equipment and methods for providing grips for sporting equipment are described.

24 Claims, 13 Drawing Sheets

(56) References Cited

U.S. PATENT DOCUMENTS

| | | | | |
|---|---|---|---|---|
| 7,458,903 | B2 | 12/2008 | Wang | |
| 7,461,474 | B1 | 12/2008 | Lu et al. | |
| 7,862,445 | B2 | 1/2011 | Huang | |
| 7,862,446 | B2 | 1/2011 | Huang | |
| 8,226,497 | B2 * | 7/2012 | Chu et al. | 473/300 |
| 2002/0107088 | A1 | 8/2002 | Lamkin et al. | |
| 2003/0207241 | A1 | 11/2003 | Manual et al. | |
| 2003/0211900 | A1 | 11/2003 | Novak et al. | |
| 2003/0216192 | A1 * | 11/2003 | Chu | 473/300 |
| 2004/0248664 | A1 * | 12/2004 | Billings | 473/300 |
| 2006/0009304 | A1 | 1/2006 | Tremulis et al. | |
| 2006/0094525 | A1 | 5/2006 | Hung | |
| 2006/0116215 | A1 | 6/2006 | Jaw | |
| 2006/0199660 | A1 | 9/2006 | Huang | |
| 2007/0015599 | A1 * | 1/2007 | Yang et al. | 473/300 |
| 2007/0032309 | A1 | 2/2007 | Chang | |
| 2007/0173342 | A1 | 7/2007 | Turnpaugh et al. | |
| 2007/0173343 | A1 | 7/2007 | Turnpaugh et al. | |
| 2007/0243940 | A1 | 10/2007 | McCree et al. | |
| 2008/0176670 | A1 | 7/2008 | Gill | |
| 2009/0017935 | A1 | 1/2009 | Wang et al. | |
| 2009/0048036 | A1 | 2/2009 | Huang | |
| 2010/0273568 | A1 * | 10/2010 | Huang | 473/300 |
| 2011/0053704 | A1 * | 3/2011 | Huang | 473/300 |
| 2011/0111880 | A1 * | 5/2011 | Chu et al. | 473/303 |

OTHER PUBLICATIONS

Office Action issued Dec. 6, 2010 in U.S. Appl. No. 12/410,973.
Office Action issued Mar. 4, 2011 in U.S. Appl. No. 12/410,973.
http://www.bestgrips.com/custom_grips BestGrips.com—The Finest in Genuine Lether Sports Grips—Design Your Own Custom Grips Printed Jan. 11, 2011 2 Pages.
International Search Report for International Application No. PCT/US09/64968 dated Jan. 12, 2010.

* cited by examiner

GRIP FOR SPORTING EQUIPMENT

This application claims priority as a continuation-in-part of U.S. utility patent application Ser. No. 12/410,973 filed on Mar. 25, 2009 now abandoned, the disclosure of which is incorporated herein in its entirety by reference.

FIELD OF THE INVENTION

This disclosure relates generally to the field of grips for articles of sporting equipment having a gripping end, such as golf clubs and tennis rackets. In particular, the present disclosure relates to grips for incorporating one or more layers of material for displaying a decorative, textured, or informational design, and to methods for securing such layers to a grip.

BACKGROUND OF THE INVENTION

The grip provided on most sporting equipment having a gripping end, such as golf clubs, tennis rackets, and the like, provides cushioning and reduces slippage of the user's hands, thereby improving the user's enjoyment of the sport of choice. As illustrated in FIG. 1, to provide the desired cushioned, reduced slippage surface for gripping, a grip 100 for such sporting equipment sometimes takes the form of a single, solid piece 120 with a hollow interior 110 that fits over an end of the gripping end 12. In an alternative embodiment, a grip 200 for such sporting equipment may comprise a grip base 210 (often referred to as an "underlisting") and an overlapping cushioning layer 220, as shown in FIGS. 2*a* and 2*b*. The grip base 210 has ends 230 and 240 and may be slipped or rolled onto the gripping end 12, and the cushioning layer 220 may be wrapped around the grip base 210. Also, information regarding the equipment, such as a logo indicating the source of the goods, or a decorative design, may be displayed on the cushioning layer 220 of the grip.

Often, users desire large grips, for example, to accommodate the user's hand size and prevent the overlapping of the user's hands. However, increasing the size of the grip typically greatly increases the weight of the grip as well. Further, such an increase in the weight of the grip often significantly inhibits the user's performance in the sport of choice.

Typically, the cushioning layer of a grip is secured to the grip base using any of a number of adhesives well known in the art. The installer may apply the adhesive to the grip base or to the cushioning layer, or the grip base or the cushioning layer may be purchased with an adhesive substance already on the surface. The installer then simply wraps the cushioning layer around the grip base or underlisting and slips the base onto the gripping end.

Use of adhesive between the grip base and supervening layers of material, and between abutting edges of the cushioning or other layers, initially provides a strong and secure bond. However, over time and with use, the adhesive bond tends to deteriorate, impairing the bond between the material layer and the grip base and potentially resulting in a damaged or even unusable grip requiring repair or replacement. Still further, the seam left by conventional methods of securing sheets of material to grip bases as described herein may provide an undesirable feel to the user's hand.

Accordingly, there remains a need in the art for a means for securely attaching layers of material, such as cushioning layers, design sheets, and/or combinations thereof, to a grip base for a grip for sporting equipment.

SUMMARY OF THE INVENTION

In accordance with the need identified in the art, in one aspect the present disclosure describes a grip for sporting equipment having a gripping end, comprising a grip base or underlisting, a pair of grip ends having a grip end portion extending from each of the grip ends, and a center portion adapted to receive the gripping end in an interior thereof. Each grip end portion defines a receiver adapted for receiving at least a portion of one or more layers substantially overlaying the center portion. Typically, the grip end portions will be fabricated of a durable material for protecting the at least one grip end from damage and will extend various lengths along the gripping end. The center portion and grip ends may define or partially define a receiver for receiving the gripping end.

It will be appreciated that the grip end portions may be attached to the center portion using any method of attachment known in the art, for example, a friction fit, a snap fit, an adhesive, any combination of adhesive and the aforementioned fittings, and the like. In the alternative, the grip end portions and the center portion may be formed or molded as a single unit using any method of formation or molding known in the art, for example, injection molding, compression molding, extrusion molding, casting, and the like. The center portion will typically define a cross section that is narrower or thinner than, for example, the one-piece grip shown in FIG. 1, to accommodate various overlaying layers of material of differing thicknesses as will be described.

Any suitable adhesive as is known in the art may be used to affix the grip base to the gripping end, to affix the one or more layers to the center portion and to affix the one or more layers to one another. Also or in the alternative, the center portion and the one or more layers may be manufactured of compatible materials such that heat and pressure bond them together.

It will be appreciated that any material having the desired properties, such as where appropriate durability, thickness, strength, cushioning, tackiness, and aesthetically pleasing appearance may be used in fabricating the grip end portions and the receivers. Any number of suitable materials are contemplated, such as rubber, polymers, latex, natural or synthetic leather, closed cell foams, open cell foams, natural material, synthetic material, or any other material currently used in fabricating grips for sports equipment. In turn, any material having the desired properties of strength, durability, thickness, cushioning, and shock absorption required for underlying the layers may be used in fabricating the center portion, such as polymers, rubber, latex, natural or synthetic leather, natural material, synthetic material, or any other material currently used in fabricating grips for sports equipment.

Certain of the one or more layers may take any of a variety of forms, such as a hollow sleeve or cylinder, a planar sheet having two side edges, a top edge, and a bottom edge, or the like. Again, any material having the desired properties, such as where appropriate durability, thickness, strength, cushioning, tackiness, and aesthetically pleasing appearance may be used in fabricating any of the one or more layers, such as polymers, closed cell foams, open cell foams, latex, rubber, natural or synthetic leather, natural material, synthetic material, or any other material currently used in fabricating grips for sports equipment. A variety of such materials are known in the art.

In addition, any of the one or more layers may be fabricated of any suitable lightweight material, such as closed cell foams, open cell foams, polymers, or synthetic materials. The thickness of the layers formed of such a lightweight material may be increased without greatly increasing the weight of the grip, thereby allowing significant increases in the cross-sectional diameter of the grip without greatly increasing the weight of the grip. Any of the one or more layers, but typically the layer to be disposed on top of any other layers attached to the grip base, may be fabricated of a suitable substantially transparent material to provide a protective surface for a design placed on the gripping surface while still allowing visualization of the design.

The grip end portion receivers may take any form suitable to receive at least one of the one or more layers, including but not limited to a flange, rim, projecting edge, lip, slant, groove, bevel, channel, slot, slit, notch, and the like. Advantageously, the receivers assist in preventing the leakage of adhesive from an area between the center portion and the one or more layers as well as from areas between the one or more layers. In addition, the receivers assist in protecting at least a portion of opposed edges of the one or more layers attached to the grip base from damage.

In another aspect, the present disclosure provides a design sheet, that is, a layer of material incorporating a decorative, informational, and/or textured design, for overlaying at least the center portion of the above-described grip base. The design sheet includes beveled edges which, when abutting one another, define a seam disposed within a groove. The groove allows use of stitching to secure the abutting beveled edges one to the other, while keeping that stitching and the stitched seam disposed below an outer circumferential surface of the design sheet.

Still other aspects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawings incorporated in and forming a part of the specification illustrate several aspects of the present invention and, together with the description, serve to explain the principles of the invention. In the drawings.

Reference will now be made in detail to the presently preferred embodiment of the invention, an example of which is illustrated in the accompanying drawings.

DETAILED DESCRIPTION OF THE INVENTION

Figure 1:
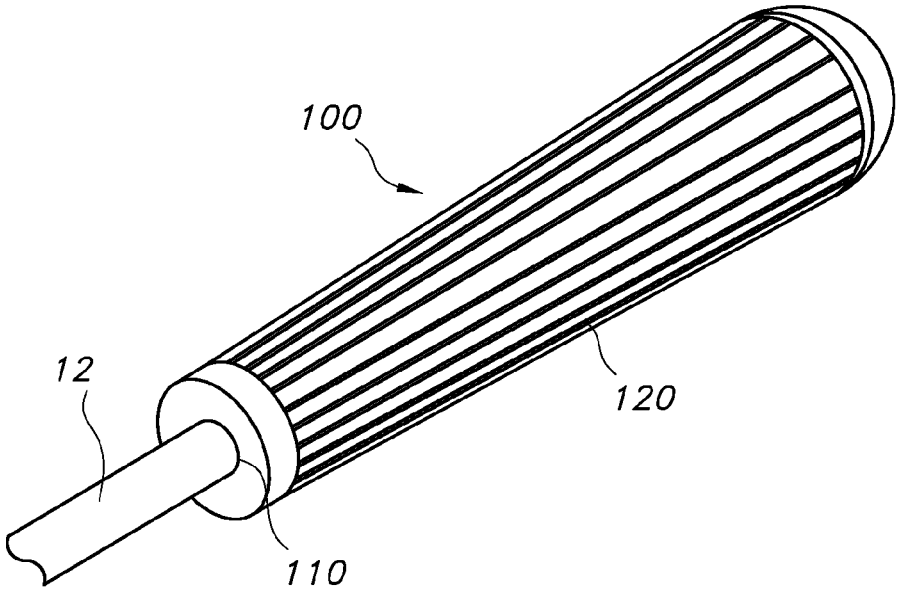
FIG. 1 (Prior Art)
FIG. 1 is a perspective view of a prior art grip formed of a single, solid piece of material.
Figure 2A:
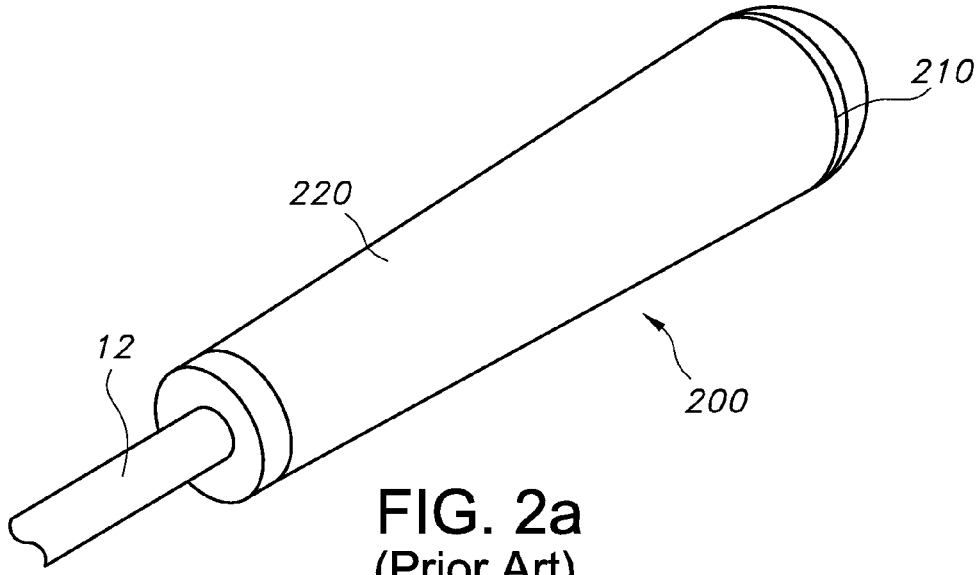
FIG. 2a (Prior Art)
FIG. 2*a* is a perspective view of a prior art grip having a hollow cylinder and an overlapping cushioning layer.
Figure 2B:
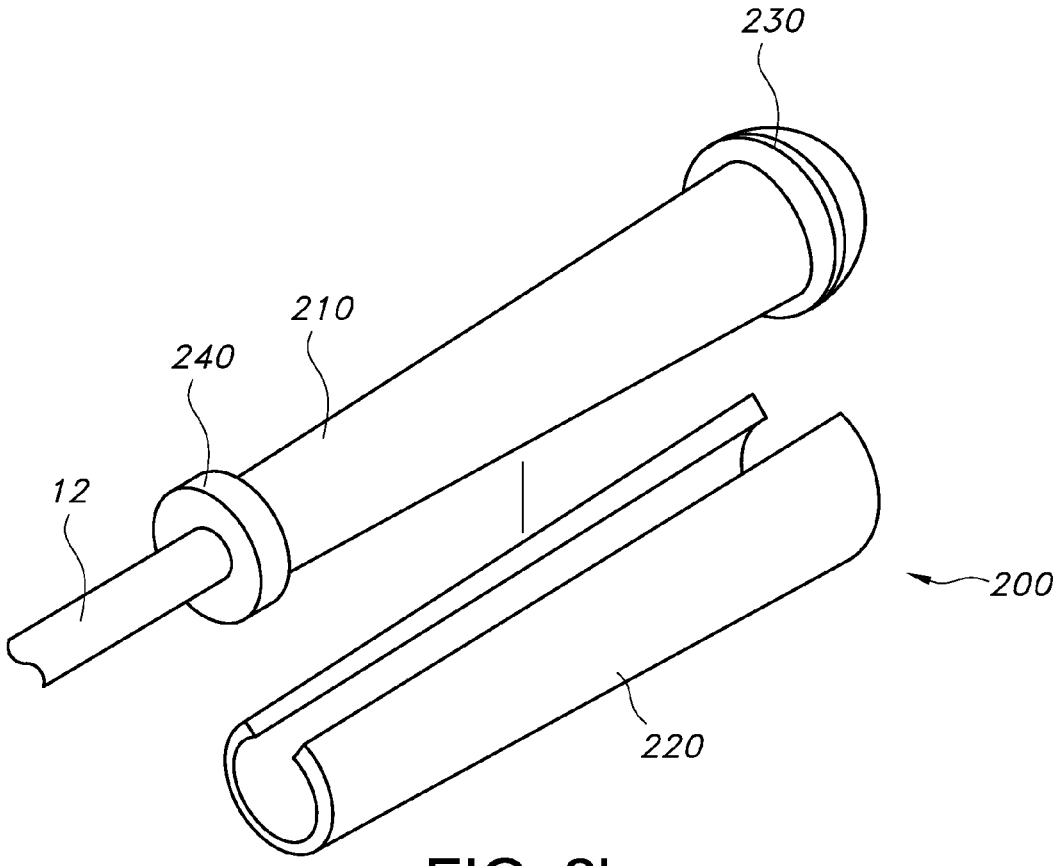
FIG. 2b (Prior Art)
FIG. 2*b* shows an exploded view of the prior art grip of FIG. 2*a* having a hollow cylinder and an overlapping cushioning layer.
Figure 3:
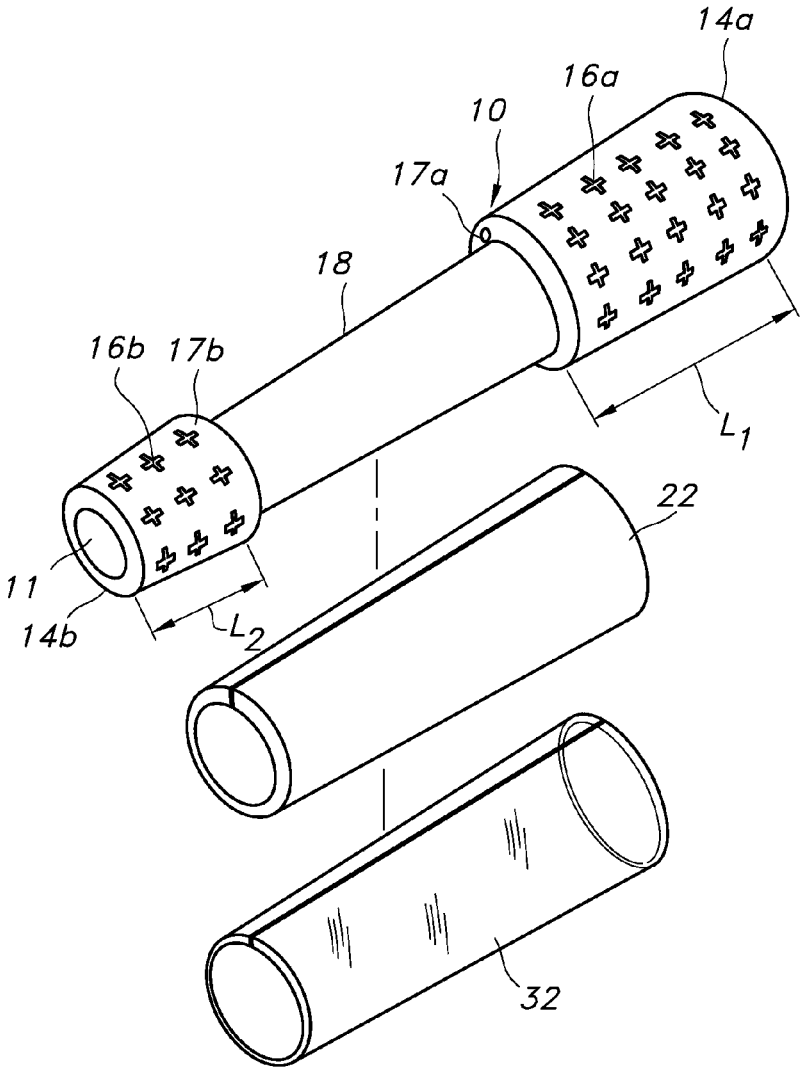
FIG. 3 is an exploded view of an embodiment of the grip of the present invention, having grip end portions, a center portion, and layers, including a cushioning layer and a transparent layer, for overlaying the center portion.
Figure 6:
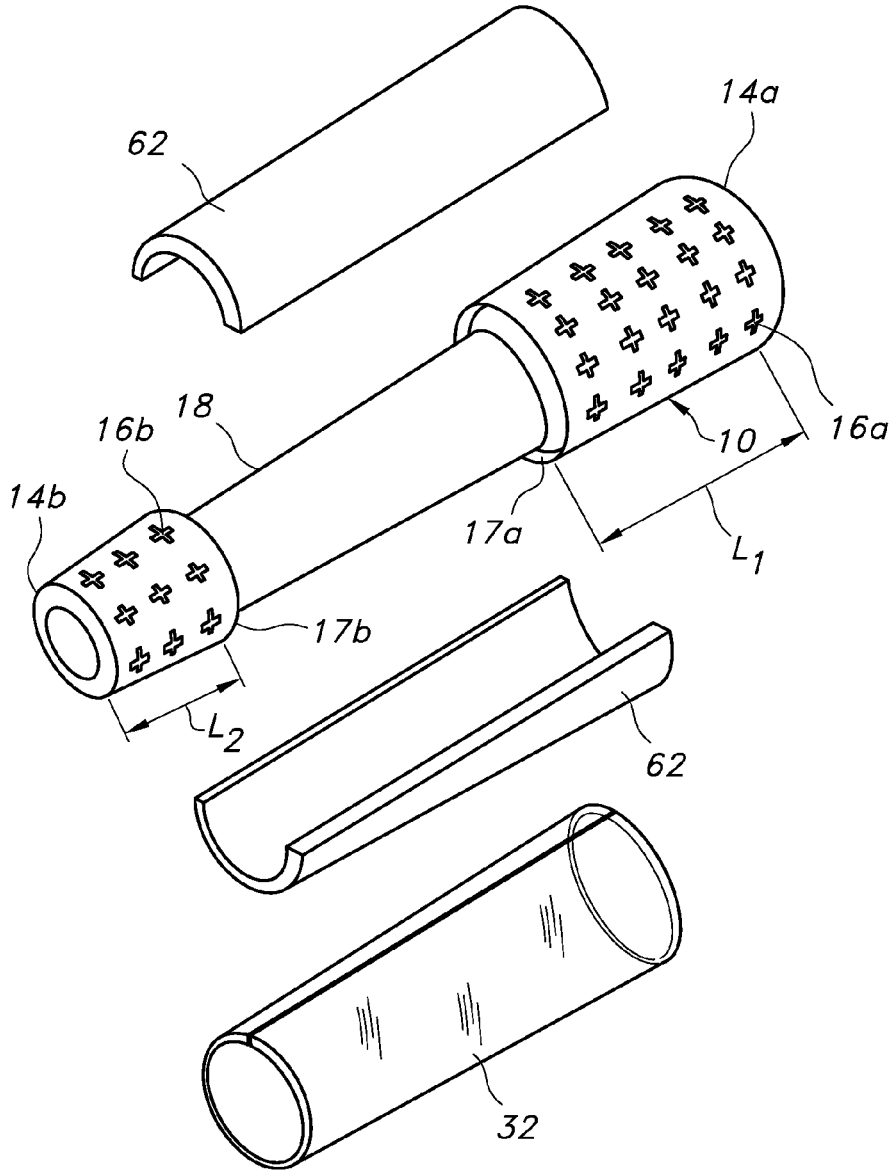
FIG. 6 is an exploded view of another embodiment of the grip of the present invention, having grip end portions, a center portion, and layers, including a lightweight layer and a transparent layer, for overlaying the center portion.

In one aspect, the present disclosure provides a grip base 10 for sporting equipment having a gripping end. As illustrated in FIGS. 3 and 6, the grip base 10 comprises grip ends 14*a* and 14*b*, grip end portions 16*a* and 16*b*, and a center portion 18. The grip end portions 16*a* and 16*b* extend by lengths $L_1$ and $L_2$, respectively, from the grip ends 14*a* and 14*b*, respectively. The grip end portions 16*a* and 16*b* may be fabricated of a durable material for protecting the grip ends 14*a* and 14*b* from damage.

Figure 4:
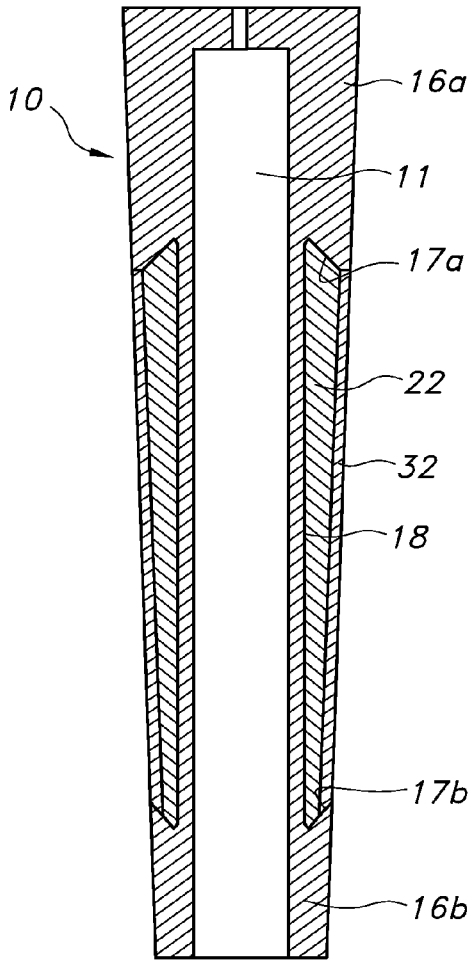
FIG. 4 shows a side cross-sectional view of the grip of FIG. 3.
Figure 5:
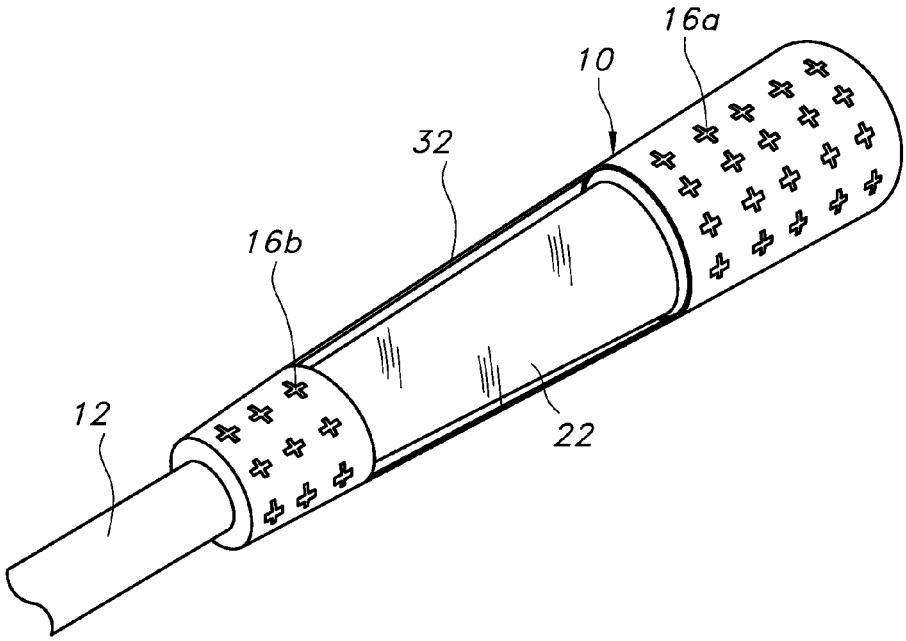
FIG. 5 shows a perspective view of the grip of FIGS. 3 and 4 installed on a gripping end of sporting equipment.
Figure 7:
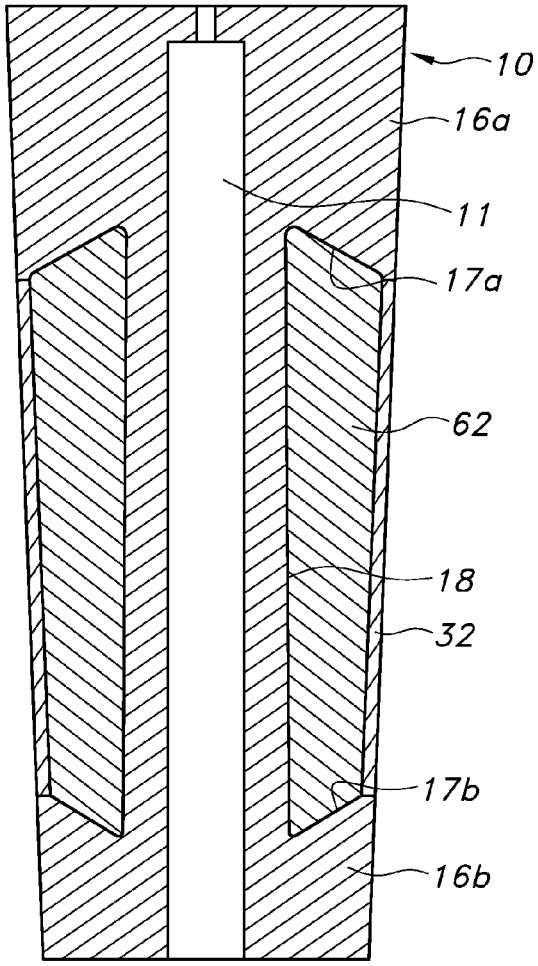
FIG. 7 shows a side cross-sectional view of the grip of FIG. 6.
Figure 8:
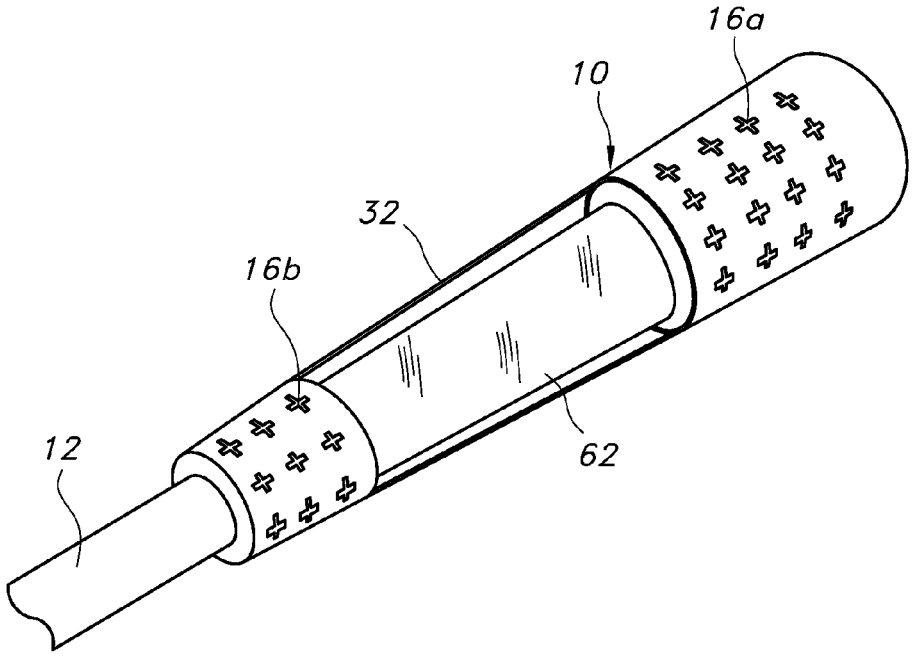
FIG. 8 shows a perspective view of the grip of FIGS. 6 and 7 installed on a gripping end of sporting equipment.

The center portion 18, which may take the form of a hollow cylinder, is located between the grip end portions 16*a* and 16*b*. The center portion is adapted for receiving the gripping end 12 in an interior thereof, as shown in FIGS. 5 and 8. The grip end portions 16*a* and 16*b* are also adapted for receiving the gripping end 12 in an interior 11 thereof. Turning to FIGS. 4 and 7, the grip end portions 16*a* and 16*b* define receivers 17*a* and 17*b*, respectively. In combination, the center portion 18 and the receivers 17*a* and 17*b* define an area to which one or more layers of material may be applied and attached to center portion 18 of the grip 10.

Figure 10A:
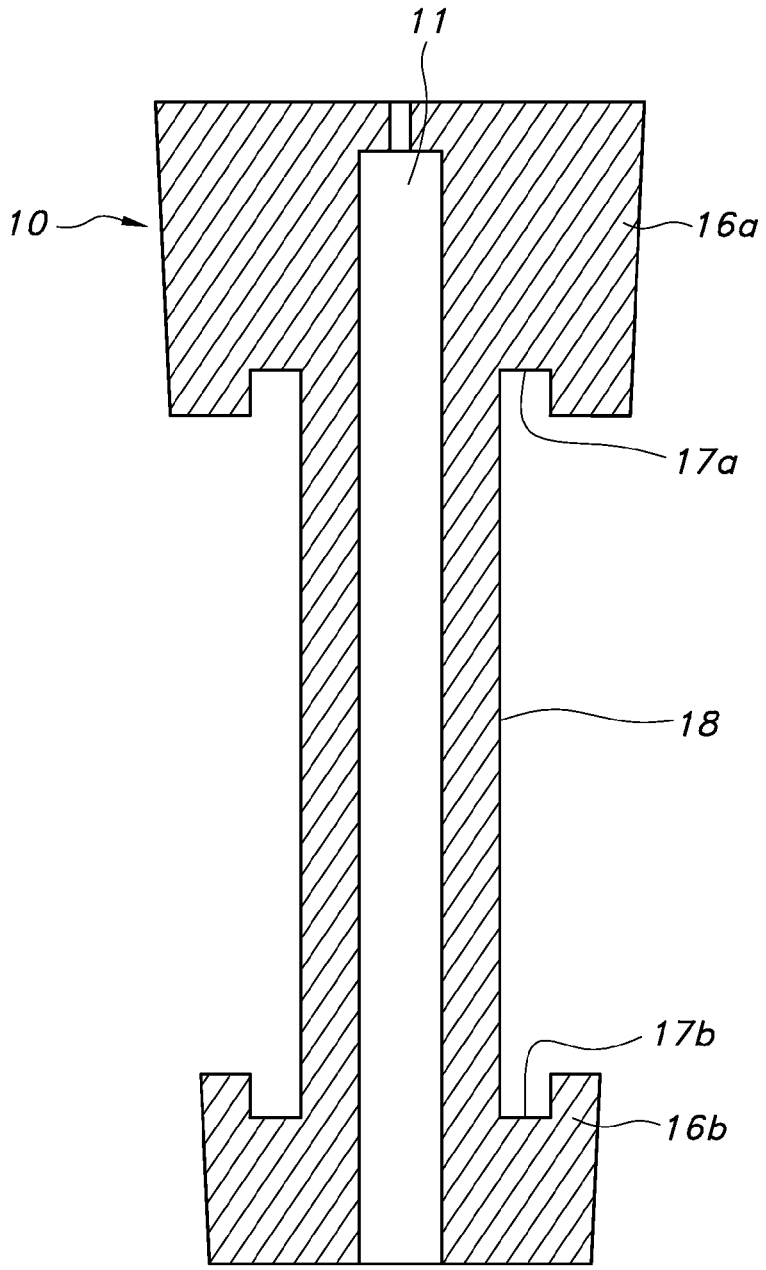
FIGS. 10*a*-10*c* show different embodiments of the grip end portion receivers of the grip of FIG. 4.
Figure 10B:
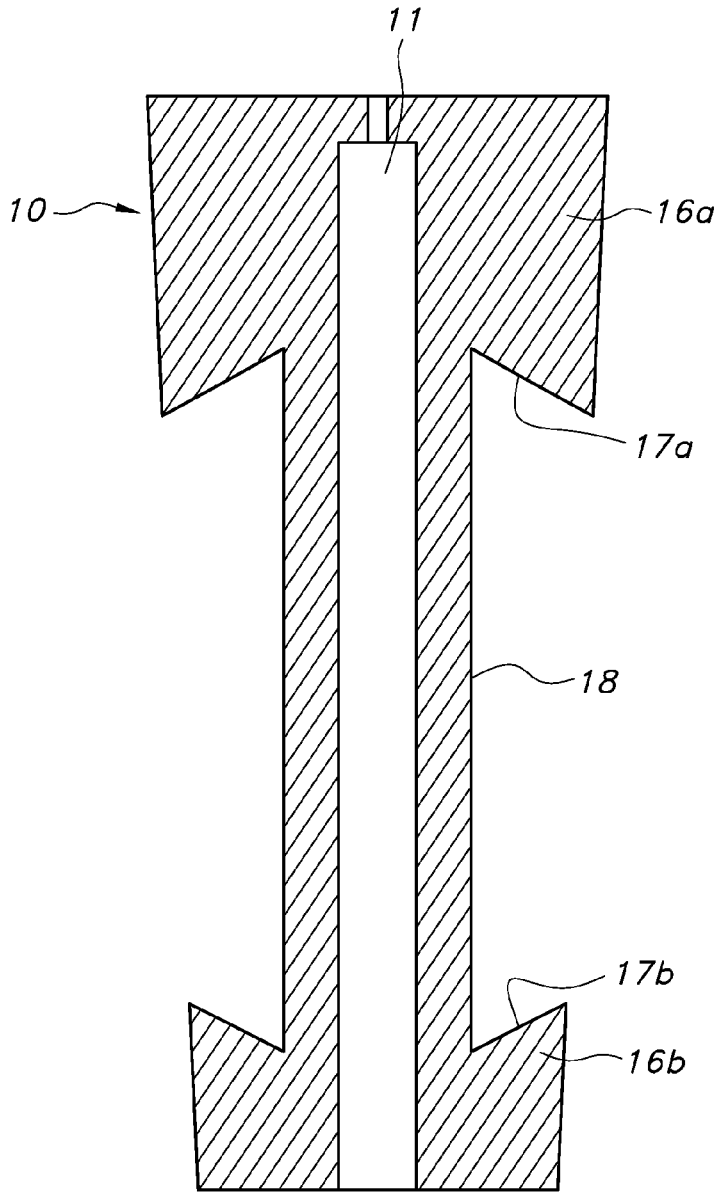
Figure 10C:
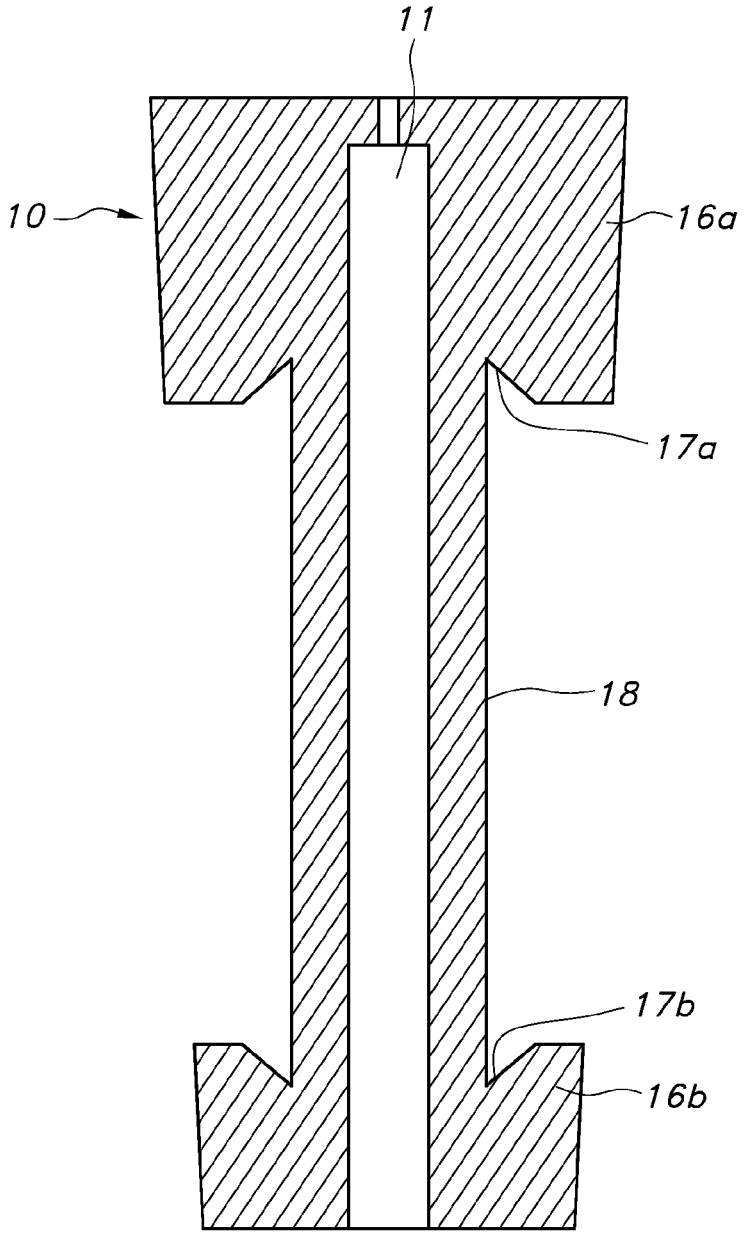

The receivers 17*a* and 17*b* may be adapted to receive a first layer of material, such as a layer 22 or 62, disposed over the center portion. In this manner, the receivers 17*a* and 17*b* assist in protecting opposed edges of the first layer from damage. The receivers 17*a* and 17*b* may take any form suitable to receive the first layer. Exemplary forms of the receivers 17*a* and 17*b* include, without limitation, a flange, rim, projecting edge, lip, slant, groove, bevel, channel, slot, slit, or notch. Non-limiting examples of embodiments of receivers 17*a* and 17*b* are shown in FIGS. 10*a*-10*c*. The first layer may also take any of a variety of forms, such as a hollow sleeve or cylinder, a planar sheet having two side edges, a top edge, and a bottom edge, or the like. A second layer of material, such as a layer 32, may also be disposed over the first layer, and the receivers 17*a* and 17*b* may be adapted also to receive the second layer. Accordingly, the receivers 17*a* and 17*b* may also assist in protecting opposed ends of the second layer from damage.

Figure 9:
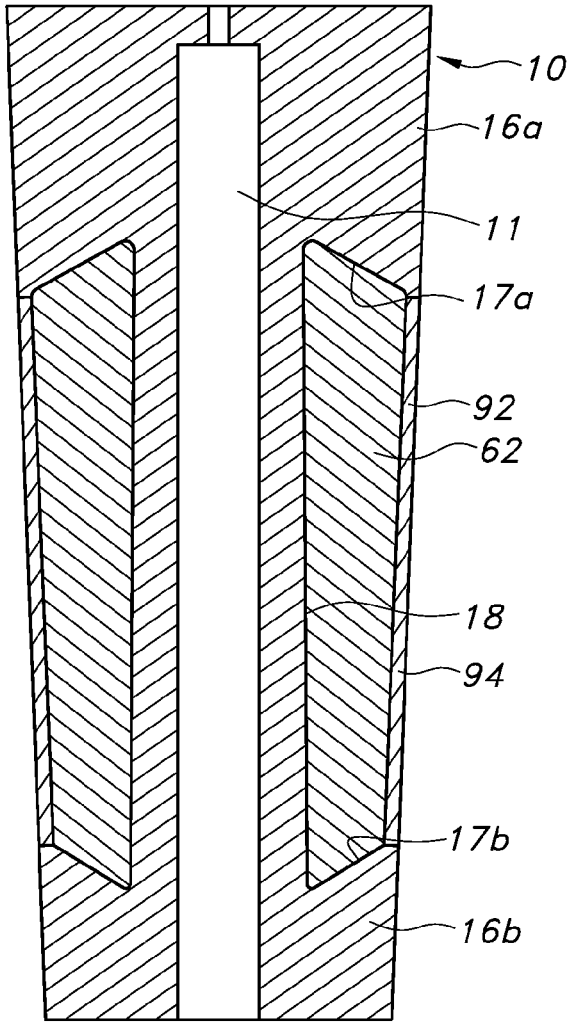
FIG. 9 is a side cross-sectional view of another embodiment of the grip of the present invention, having grip end portions, a center portion, and layers, including a lightweight layer, a cushioning layer, and a transparent layer, for overlaying the center portion.

As illustrated in FIG. 9, a third layer, such as a layer 94, may be disposed over the second layer, such as a layer 92, and the second layer may be disposed over the first layer, such as a layer 62. The receivers 17*a* and 17*b* may be adapted also to receive the third layer. It will be appreciated that multiple additional layers could be disposed over first, second, and third layers, in accordance with the needs and desires of the user, i.e. in accordance with the desired properties of cushioning, aesthetics, thickness or diameter, durability, tackiness, etc.

By selecting materials which provide the desired properties and applying same in multiple layers rather than as single solid pieces or fewer layers as conventionally done in the art, it is possible to provide a grip having desired properties without significantly increasing total weight. As a non-limiting example, a first layer 22 could be selected for a desirable property of durability, a second layer 32 could be selected for a desirable property of cushioning, and a third layer 94 could be selected for a desirable property of tackiness. By using these three layers, rather than a grip formed of a single piece of material or an underlisting and a single thick layer of material wrapped around that underlisting, properties of durability, cushioning, and tackiness can be imparted while still providing a finished grip of lesser weight.

Returning to FIG. 3, it will also be appreciated that the grip end portions 16*a* and 16*b* may be attached to the center portion 18 using any method of attachment known in the art. For example, a combination of adhesive and friction fit may be used to attach the grip end portions 16*a* and 16*b* to the center portion 18. Alternatively, only a friction fit or only an adhesive may be desirable. In still other embodiments, snap fit structures may be used for attaching the grip end portions 16*a* and 16*b* to the center portion 18. Even further, the grip end portions 16*a* and 16*b* and the center portion 18 may be formed or molded as a single unit using any method of formation or molding known in the art. For example, injection molding, compression molding, extrusion molding, casting, and the like may be used to form the grip end portions 16*a* and 16*b* and the center portion 18 as a single unit.

Also, a suitable adhesive may be coated onto an outer surface of the center portion 18 to affix the first layer, such as the layer 22, to the center portion 18. Alternatively, the adhesive may be coated onto an inner surface of the first layer, or onto both surfaces. Still further, the center portion or the first layer may be pre-coated with the adhesive during manufacture. Numerous suitable adhesives are known in the art. In other embodiments, the center portion and the first layer may be manufactured of compatible materials such that application of sufficient heat and/or pressure cause them to form a bond. The first layer may then be placed over or wrapped around the center portion 18 and received in the receivers 17*a* and 17*b*. In this manner, the receivers 17*a* and 17*b* may assist in preventing the leakage of adhesive from an area between the first layer and the center portion 18.

A suitable adhesive may also be coated onto an outer surface of the first layer, such as the layer 22, onto an inner surface of the second layer, such as the layer 32, or onto both surfaces to affix the surfaces together. Alternatively, the first layer or the second layer may be pre-coated with the adhesive during manufacture. Again, numerous suitable adhesive substances are known in the art. In yet another embodiment, the layers may be manufactured of compatible materials such that heat and pressure bond them together. The second layer may then be placed over the first layer and received in the receivers 17*a* and 17*b*. In this regard, the receivers 17*a* and 17*b* may also assist in preventing the leakage of adhesive from an area between the second layer and the first layer.

Turning to FIG. 9, a suitable adhesive may be also used to connect the second layer, such as the layer 92, and the third layer, such as the layer 94, as well as any subsequent layers. In turn, the third and any subsequent layers may then be received in the receivers 17*a* and 17*b*, and the receivers 17*a* and 17*b* may also assist in preventing the leakage of adhesive from areas between these layers.

Returning to FIG. 3, the lengths $L_1$ and $L_2$ of the grip end portions 16*a* and 16*b* may be varied to any length having the desired property of protecting the grip ends from damage. In particular embodiments, the grip end portions 16*a* and 16*b* may be manufactured to extend along a length of from about 1 millimeter to about 98 millimeters along the gripping end 12 (shown in FIG. 5). In other embodiments, the grip end portions flanges may be manufactured to extend along a length of at least 0.05 inches from an edge of the grip end portions. It will be appreciated that the grip end portions may also extend various other lengths along the gripping end.

Any material having one or more desired properties of durability, thickness, strength, cushioning, tackiness, and aesthetically pleasing appearance may be used in fabricating the grip end portions 16*a* and 16*b* and the receivers 17*a* and 17*b*, such as rubber, polymers, latex, natural or synthetic leather, closed cell foams, open cell foams, natural material, synthetic material, or any other material currently used in fabricating grips for sports equipment. The thickness of the grip end portions may be varied in accordance with the needs of the user, i.e. in accordance with the preferred thickness/diameter of the finished grip.

Any material having one or more desired properties of durability, thickness, strength, cushioning, tackiness, and shock absorption required for underlying the layers may be used in fabricating the center portion 18, such as polymers, rubber, latex, natural or synthetic leather, natural material, synthetic material, or any other material currently used in fabricating grips for sports equipment. The thickness of the center portion may also be varied in accordance with the needs of the user, i.e. in accordance with the user's hand size and preferred grip thickness.

Also, any material having the desired properties of cushioning, tackiness, aesthetics, durability, thickness, strength, and aesthetically pleasing appearance required for a slip-resistant grip may be used in fabricating any of the layers, such as polymers (for example polystyrene or polyurethane), closed cell foams, open cell foams, latex, rubber, natural or synthetic leather, natural material, synthetic material, or any other material currently used in fabricating grips for sports equipment. The thickness of any of the layers may be varied in accordance with the needs of the user, i.e. in accordance with the user's hand size and preferred grip thickness.

In addition, any of the layers may be fabricated of any suitable lightweight material, such as closed cell foams, open cell foams, polymers (for example polystyrene or polyurethane), or synthetic foams. In addition, an elongated strip, such as the elongated strip with a locking mechanism as is described in the present inventor's U.S. Pat. No. 6,971,959 for a Grip for Sports Equipment, the entirety of which is incorporated herein by reference, may be used to provide one or more of the recited layers. As illustrated in FIGS. 6-9, the thickness of the layers, such as the layer 62, formed of such a lightweight material may be increased without greatly increasing the weight of the grip, thereby increasing the size of the grip without greatly increasing the weight of the grip. In this manner, an oversized grip of reduced weight may be provided. Such a reduced weight oversized grip may be desirable for various reasons, such as accommodating the user's hand size and preventing the overlapping of the user's hands without increasing the grip weight (and by extension the weight of the equipment to which the grip is attached) to a weight that inhibits the user's performance in the sport of choice.

Any of the layers also may be fabricated of a suitable substantially transparent material and may protect a design placed on the grip while still allowing visualization of the design. Typically, the substantially transparent layer would be positioned on top of any other layers forming the finished grip. Such a system is described in the present inventor's U.S. Pat. No. 6,718,675 for a Display Grip for Sports Equipment, the entirety of which is incorporated herein by reference.

Figure 11:
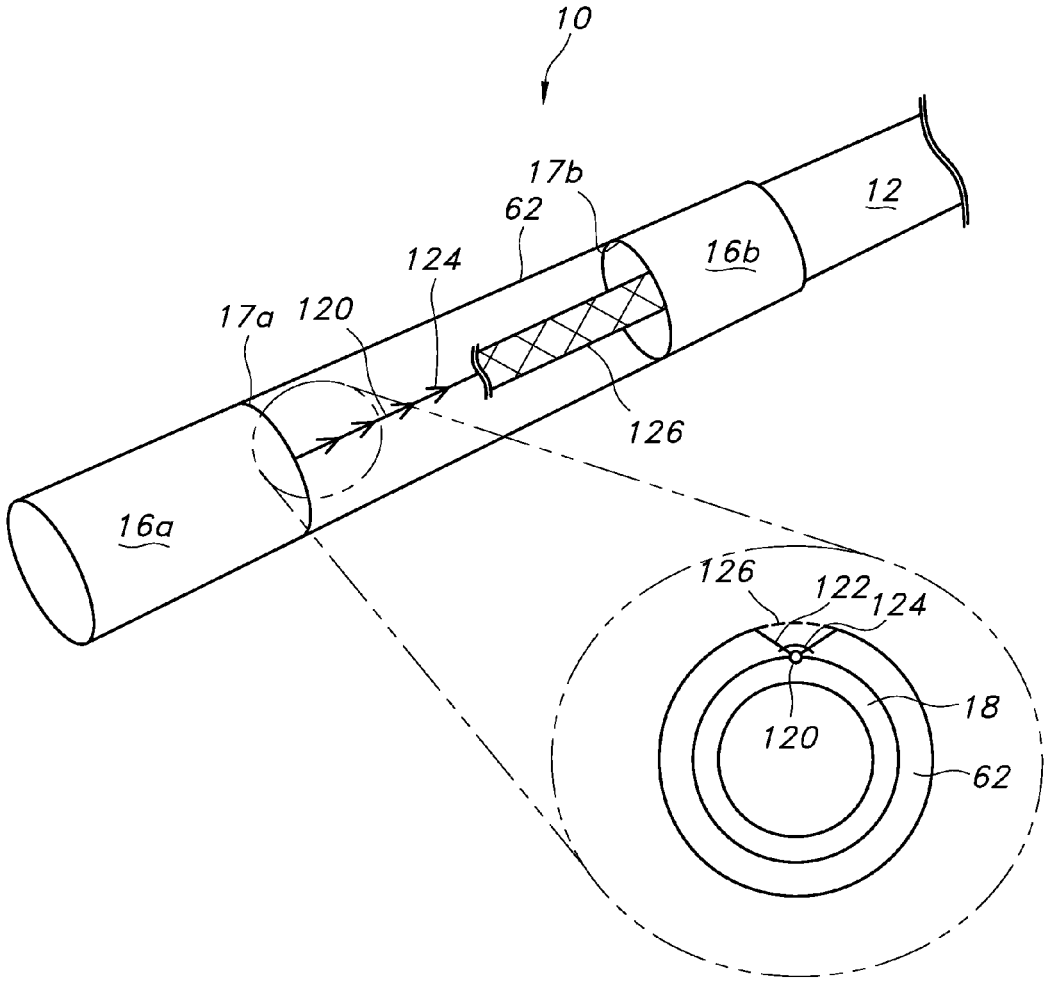
FIG. 11 shows a design sheet affixed to a grip base according to the present disclosure.

Turning to FIG. 11, there is shown an embodiment of a material layer 62 encircling center portion 18 (shown in the inset figure) of a grip base 10 according to the present disclosure. As shown therein, layer 62 encircles center portion 18, and may be attached thereto by any conventional means such as a suitable adhesive. A seam 120 is defined between adjacent abutting edges of layer 62. Of course, layer 62 affixed to center portion 18 may present a plain outer surface, or may present an outer surface displaying a decorative, textured, or informational design (not shown for convenience).

As shown in FIG. 11 (see inset), the layer 62 edges that abut one another to define seam 120 are beveled to define a groove 122 with seam 120 disposed in an interior portion thereof. In this manner, the seam 120 is disposed below a plane defined by an outer circumference of layer 62 when disposed on grip base 10, and can be protected from contact by a user's hands as will be discussed in detail below.

Stitching 124 is used to secure layer 62 beveled edges one to another, without extending that stitching into center portion 18 of grip base 10. That is, the stitches pass through the material of layer 62, but not the material of center portion 18 or of any other layer of material which may underly layer 62. Accordingly, even if the gripping strength of the adhesive deteriorates over time or through use, layer 62 will remain secured to grip base 10. Further, as shown in FIG. 11, stitching 124, like seam 120, is disposed below a plane defined by an outer circumference of layer 62 when disposed on grip base 10. An adhesive strip 126 (shown for convenience as a partial strip 126 in FIG. 11), such as a seam tape, covers seam 120 and stitching 124. The seam tape may present a plain outer surface or may include a textured outer surface that is the same as or is distinct from the outer surface of layer 62, according to user and/or manufacturer preferences. In this manner, the user will not be able to feel either of seam 120 or stitching 124 during use of the finished grip, further improving acceptance of the grip of the present disclosure.

Stitching 124 defining any suitable pattern is contemplated for use. As non-limiting examples, it is contemplated to use any one of a continuous running stitch, a "baseball" stitch, or a running locked stitch as are well known in the stitching and suturing arts for closing and/or securing a longitudinal seam or cut as described herein.

Finally (not shown in FIG. 11, but see FIGS. 3, 5, 6, and 8), a substantially transparent top layer 32 may be overlaid over at least layer 62, providing a protective covering that allows visualization of any design element of layer 62. Top layer 32 may be a planar sheet (FIGS. 3 and 6), but may also be configured as a hollow sleeve (not shown) which may be slipped or rolled over layer 62. Still further, it is contemplated to form the substantially transparent top layer 32 by applying a liquid polymer to an outer surface of the grip base 10 and/or layer 62, and drying the liquid polymer to provide a substantially transparent film. The liquid polymer may be applied by dipping, rolling, brushing, or spraying, or by any other suitable means for applying a liquid polymer. Particularly in the case where layer 62 incorporates a decorative or informational design element, but also in any situation where it is desired to provide additional protection to any element of a layer 62 as disclosed herein, it will be appreciated that this feature allows applying a protective layer 32 whereby such a decorative or informational design element may be viewed without risk of damage from the elements or through use.

Accordingly, the grip of the present invention provides several advantages over conventional grips. One or more of the layers of the disclosed grip may be fabricated of any suitable lightweight material, allowing the size of the grip to be increased without greatly increasing the weight of the grip. At the same time, the grip of the present invention does not compromise the desirable properties of the grip or prevent the display of information on the gripping area.

Because the receivers 17*a* and 17*b* of the grip receive the layers, the incidence of leakage of the adhesive during fabrication or use of the grip from the inner surfaces of the layers of the grip is reduced. In this manner, staining and damaging of the layers from leaking adhesive is also reduced, and the grip's ability to provide a cushioned, reduced slippage surface without damage from leaking adhesive is enhanced. The reduction of leaking adhesive lessens damage to or obscuring of information and decorative designs displayed on the grip. Still further, receivers 17*a* and 17*b* protect at least a portion of any layers of material applied to the grip base 10, such as the edges of such layers, from damage, wear and tear, etc. In addition, the thickness and durability of the grip end portions may assist in reducing damage to the grip from contact with other grips, golf bags, etc.

Still further, the presently described feature of securing a layer 62 such as a design sheet using both adhesive and a stitch pattern disposed within a groove defined by abutting edges of that layer allows better securing to a grip according to the present disclosure, while at the same time providing a means by which the seam and the stitching are hidden and/or removed from contact by a user's hands, improving acceptance by the user.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, an end cap may overlay an end of the grip end portion 16*a* on the distal portion of gripping end 12, either before or after the grip 10 of the present invention is installed thereon, using a combination of adhesive and a friction fit as is known in the art. A rib and groove structure as is described in the present inventor's U.S. Pat. No. 6,718,675 for a Display Grip for Sports Equipment may also be used to secure the grip end portion 16*a* to the end cap.

The embodiment described was chosen to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. A grip for sporting equipment having a gripping end, comprising:

a base defining a receiver for receiving the gripping end, the base comprising a pair of opposed grip base ends and an intervening center portion;

at least one sheet of material for encircling at least the base center portion, the at least one sheet of material including at least two opposedly oriented beveled edges which when abutting define a seam, the seam being disposed within a groove and below a plane defined by a top surface of the at least one sheet of material; and stitching disposed within the groove and securing the abutting portions of the at least two opposedly oriented beveled edges one to the other.

2. The grip of claim 1, further including an adhesive strip overlaying the groove and stitching.

3. The grip of claim 2, further including a substantially transparent top protective layer for overlaying at least a portion of the at least one sheet of material, the adhesive strip, and the base.

4. The grip of claim 3, wherein each grip base end includes a flange for receiving and at least partially overlapping an edge of the at least one sheet of material and the top layer.

5. The grip of claim 4, wherein each grip base end flange extends at least 0.05 inches from an edge of the grip base end.

6. The grip of claim 3, wherein the substantially transparent top layer is provided as one of a hollow sleeve, as a substantially planar sheet, as an elongated ribbon strip wrapping, or as a film applied by brushing, spraying, rolling, or dipping the base and at least one sheet of material with a suitable liquid polymer.

7. The grip of claim 1, wherein the stitching is selected from one of a continuous running stitch, a baseball stitch, or a running locked stitch.

8. The grip of claim 1, wherein the stitching passes through only the opposedly beveled abutting edges of the at least one sheet of material.

9. An article of sporting equipment, comprising;

a shaft extending from a distal end to a gripping end; and a grip positioned on the gripping end;

wherein the grip comprises:

a base defining a receiver for receiving the gripping end, the base comprising a pair of opposed grip base ends and an intervening center portion;

at least one sheet of material for encircling at least the base center portion, the at least one sheet of material including at least two opposedly oriented beveled edges which when abutting define a seam, the seam being disposed within a groove and below a plane defined by a top surface of the at least one sheet of material; and stitching disposed within the groove and securing the abutting portions of the at least two opposedly oriented beveled edges one to the other.

10. The article of claim 9, further including an adhesive strip overlaying the groove and stitching.

11. The article of claim 10, further including a substantially transparent top protective layer for overlaying at least a portion of the at least one sheet of material, the adhesive strip, and the base.

12. The article of claim 11, wherein each grip base end includes a flange for receiving and at least partially overlapping an edge of the at least one sheet of material and the top layer.

13. The article of claim 12, wherein each grip base end flange extends at least 0.05 inches from an edge of the grip base end.

14. The article of claim 11, wherein the substantially transparent top layer is provided as one of a hollow sleeve, as a substantially planar sheet, as an elongated ribbon strip wrapping, or as a film applied by brushing, spraying, rolling, or dipping the base and at least one sheet of material with a suitable liquid polymer.

15. The item of claim 9, wherein the stitching is selected from one of a continuous running stitch, a baseball stitch, or a running locked stitch.

16. The article of claim 9, wherein the stitching passes through only the opposedly beveled abutting edges of the at least one sheet of material.

17. A method of making a grip for sporting equipment having a gripping end, comprising:

providing a base defining a receiver for receiving the gripping end, the base comprising a pair of opposed grip base ends and an intervening center portion;

providing at least one sheet of material including at least two opposedly oriented beveled edges which when abutting define a seam, the seam being disposed within a groove and below a plane defined by a top surface of the at least one sheet of material;

wrapping the at least one at least one sheet of material around at least the base center portion; and securing the abutting portions of the at least two opposedly oriented beveled edges one to the other by stitching disposed within the groove.

18. The method of claim 17, further including overlaying the groove and stitching with an adhesive strip.

19. The method of claim 18, further including overlaying at least a portion of the at least one sheet of material, the adhesive strip, and the base with a substantially transparent top protective layer.

20. The method of claim 19, including providing a grip base wherein each grip base end includes a flange for receiving and at least partially overlapping an edge of the at least one sheet of material and the top layer.

21. The method of claim 20, including providing a grip base end having a flange extending at least 0.05 inches from an edge of the grip base end.

22. The method of claim 19, including providing the substantially transparent top layer as one of a hollow sleeve, a substantially planar sheet, an elongated ribbon strip wrapping, or a film applied by brushing, spraying, rolling, or dipping the base and at least one sheet of material with a suitable liquid polymer.

23. The method of claim 17, including the step of selecting the stitching from one of a continuous running stitch, a baseball stitch, or a running locked stitch.

24. The method of claim 17, including providing stitching passing through only the opposedly beveled abutting edges of the at least one sheet of material.

* * * * *